US006843703B1

(12) United States Patent
Iaconis et al.

(10) Patent No.: US 6,843,703 B1
(45) Date of Patent: Jan. 18, 2005

(54) ELECTROMECHANICAL TOY

(75) Inventors: Michael J. Iaconis, Wrentham, MA (US); Richard Maddocks, Barrington, RI (US); Leif J. Askeland, Cranston, RI (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 10/425,992

(22) Filed: Apr. 30, 2003

(51) Int. Cl.[7] ..... A63H 3/02
(52) U.S. Cl. ..... 446/371; 446/369; 446/376
(58) Field of Search ..... 446/369, 175, 446/303, 355, 356, 358, 330, 352, 353, 376, 377, 383, 371

(56) References Cited

U.S. PATENT DOCUMENTS

| | | | | |
|---|---|---|---|---|
| 112,550 | A | | 3/1871 | Clay |
| 1,639,442 | A | | 8/1927 | Strauss et al. |
| 1,992,477 | A | | 2/1935 | Domowitch et al. |
| 2,194,537 | A | | 3/1940 | Adams |
| 2,421,279 | A | | 5/1947 | Marty |
| 2,614,365 | A | | 10/1952 | Musselwhite et al. |
| 2,620,594 | A | | 12/1952 | Parisi |
| 3,266,059 | A | | 8/1966 | Stelle |
| 3,484,988 | A | | 12/1969 | Robbins |
| 3,940,879 | A | * | 3/1976 | Glass et al. ..... 446/276 |
| 3,981,098 | A | | 9/1976 | Darda |
| 4,086,724 | A | | 5/1978 | McCaslin |
| 4,109,913 | A | | 8/1978 | Nielsen |
| 4,125,261 | A | | 11/1978 | Lahr |
| 4,155,197 | A | | 5/1979 | Beny et al. |
| 4,165,581 | A | | 8/1979 | Wolf |
| 4,224,759 | A | | 9/1980 | Saint-Pierre et al. |
| 4,231,183 | A | | 11/1980 | Lahr |
| 4,245,515 | A | | 1/1981 | Iwaya |
| 4,248,012 | A | | 2/1981 | Kirby et al. |
| 4,276,717 | A | | 7/1981 | Zbriger et al. |
| 4,333,261 | A | | 6/1982 | Jones et al. |
| 4,363,187 | A | | 12/1982 | Shinohara |
| 4,453,712 | A | | 6/1984 | Lee |
| 4,479,327 | A | | 10/1984 | Wakimura |
| 4,494,417 | A | | 1/1985 | Larson et al. |
| 4,516,951 | A | | 5/1985 | Saigo et al. |
| 4,540,176 | A | | 9/1985 | Baer |
| 4,571,208 | A | | 2/1986 | Saigo et al. |
| 4,595,381 | A | | 6/1986 | Dibold et al. |
| 4,601,671 | A | | 7/1986 | DeMars |
| 4,636,177 | A | | 1/1987 | Koguchi |
| 4,655,724 | A | | 4/1987 | Law |

(List continued on next page.)

FOREIGN PATENT DOCUMENTS

| | | | |
|---|---|---|---|
| DE | 19755465 | A1 | 12/1997 |
| DE | 19755464 | | 6/1999 |
| GB | 2221401 | A | 2/1990 |
| GB | 2222959 | A | 3/1990 |
| JP | 11-207042 | | 8/1999 |
| JP | 2001-300149 | | 10/2001 |

OTHER PUBLICATIONS

U.S. Appl. No. 10/305,265, filed Nov. 27, 2002.
U.S. Appl. No. 10/667,977, filed Sep. 23, 2003.
U.S. Appl. No. 10/698,930, filed Nov. 3, 2003.

*Primary Examiner*—Derris H. Banks
*Assistant Examiner*—Jamila Williams
(74) *Attorney, Agent, or Firm*—Fish & Richardson P.C.

(57) ABSTRACT

A toy includes a body and an appendage system at a side of the body. The appendage system includes an arm and a linkage. The arm includes a first end fixed to rotate in a circular path and a second unfixed end. The arm defines a slot extending between the first and second ends. The linkage includes a linkage rod that is engaged with the slot. The linkage is positionable about a linkage shaft coupled to the body. Rotation of the first end of the arm causes the second unfixed end of the arm to move in a non-circular path that varies depending on the position of the linkage about the linkage shaft.

20 Claims, 16 Drawing Sheets

U.S. PATENT DOCUMENTS 4,662,854 A 5/1987 Fang
4,673,371 A 6/1987 Furukawa
4,708,688 A 11/1987 Lee
4,717,364 A 1/1988 Furukawa
4,795,395 A 1/1989 Oishi et al.
4,798,553 A 1/1989 Gentles et al.
4,802,878 A 2/1989 Terzian et al.
4,815,911 A 3/1989 Bengtsson et al.
4,828,525 A 5/1989 Okano
4,846,756 A 7/1989 Hesse
4,923,428 A 5/1990 Curran
4,944,708 A 7/1990 Kawabe
4,968,280 A 11/1990 Kelley
5,011,449 A 4/1991 Handy et al.
5,056,249 A 10/1991 Sakurai
5,080,681 A 1/1992 Erb
5,080,682 A 1/1992 Schectman
5,195,920 A 3/1993 Collier
5,267,886 A 12/1993 Wood et al.
5,295,893 A 3/1994 Chiu
5,297,443 A 3/1994 Wentz
5,324,225 A 6/1994 Satoh et al.
5,378,188 A 1/1995 Clark
5,409,447 A 4/1995 Wedge, Jr.
5,498,193 A 3/1996 Locricchio
5,647,787 A 7/1997 Raviv et al.
5,697,829 A 12/1997 Chainani et al.
5,724,074 A 3/1998 Chainani et al.
5,846,115 A 12/1998 Feng
5,908,345 A 6/1999 Choi
5,931,715 A 8/1999 Chang
6,053,797 A 4/2000 Tsang et al.
6,083,104 A 7/2000 Choi
6,139,394 A 10/2000 Maxim
6,149,490 A 11/2000 Hampton et al.
6,160,986 A 12/2000 Gabai et al.
6,200,190 B1 3/2001 Reynolds
6,200,193 B1 3/2001 Nadel
6,250,987 B1 6/2001 Choi
6,253,058 B1 6/2001 Murasaki et al.
6,322,420 B1 11/2001 Daniellian
6,371,826 B1 4/2002 Pestonji
6,386,943 B1 5/2002 Chang
6,390,883 B1 5/2002 Choi
6,402,153 B1 6/2002 Stewart
6,435,936 B1 8/2002 Rehkemper et al.
6,458,010 B1 10/2002 Yamagishi et al.
6,497,607 B1 12/2002 Hampton et al.
6,514,117 B1 2/2003 Hampton et al.
6,602,106 B2 * 8/2003 Cheung ..... 446/330

* cited by examiner

ELECTROMECHANICAL TOY

TECHNICAL FIELD

This description relates to an electromechanical toy.

BACKGROUND

Toys that have moving parts are well known. For example, dolls and plush toys such as stuffed animals are made with moveable appendages.

SUMMARY

In one general aspect, a toy includes a body and an appendage system at a side of the body. The appendage system includes an arm and a linkage. The arm includes a first end fixed to rotate in a circular path and a second unfixed end. The arm defines a slot extending between the first and second ends. The linkage includes a linkage rod that is engaged with the slot. The linkage is positionable about a linkage shaft coupled to the body. Rotation of the first end of the arm causes the second unfixed end of the arm to move in a non-circular path that varies depending on the position of the linkage about the linkage shaft.

Implementations may include one or more of the following features. For example, the toy may include a disk having an eccentric rod. The disk is rotatable about a disk shaft coupled to the body. The first end of the arm is fixed to the eccentric rod to rotate in the circular path of the eccentric rod. The toy may further include an actuator within the body and coupled to rotate the disk. The actuator may include an energy source, a motor connected to the energy source, and a driving device connected to the motor and coupled with the first end of the arm to rotate the first end of the arm when the motor operates.

The toy may also include a sensor connected to cause the first end of the arm to rotate in response to a sensed condition. The toy may include another appendage system shaped like the appendage system and positioned at another side of the body. Rotation of a first end of an arm of the other appendage system causes a second end of the arm of the other appendage system to move in a non-circular path that varies depending on the position of a linkage of the other appendage system relative to the linkage shaft coupled to the body or relative to another linkage shaft coupled to the body. The eccentric rods of each of the appendage systems may be positioned such that second end of the appendage system moves in a non-circular path that is offset from the non-circular path in which the second end of the other appendage system moves.

The toy may include a flexible skin surrounding the appendage system. The flexible skin may be made of pile that resembles an animal's coat. The flexible skin may move with the arm.

In another general aspect, an appendage system of a toy includes an arm and a linkage. The arm includes a first end configured to rotate in a circular path and a second unfixed end, the arm defining a slot extending between the first and second ends. The linkage includes a linkage rod that is engaged with the slot, the linkage being positionable about a linkage shaft coupled to the body. Rotation of the first end of the arm causes the second unfixed end of the arm to move in a non-circular path that varies depending on the position of the linkage about the linkage shaft.

Implementations may include one or more of the following features. For example, the system may include a disk including an eccentric rod. The disk is rotatable about a disk shaft coupled to the body, wherein the first end of the arm is fixed to the eccentric rod to rotate in the circular path of the eccentric rod. The first end of the arm may rotate in response to a sensed condition from a sensor within the toy.

In another general aspect, a toy includes an arm, a linkage, and a flexible skin that covers the arm. The arm includes a first end configured to rotate in a circular path and a second unfixed end. The arm defines a slot extending between the first and second ends and defining an eye at the second end. The linkage includes a linkage rod that is engaged with the slot. The flexible skin has a portion that is sewed to the eye. Rotation of the first end of the arm causes the second unfixed end of the arm to move along a non-circular path and causes the sewed portion of the flexible skin to periodically tension and slacken as the arm moves along the non-circular path.

In another general aspect, a toy includes a body and an arm at a side of the body. The arm has a first end that is fixed to rotate along a circular path and a second unfixed end that moves in a non-circular path as the first end rotates. A shape of the movement of the second unfixed end along the non-circular path depends on an initial orientation of a linkage coupled to the arm.

Implementations may include one or more of the following features. For example, the initial orientation of the linkage may be configured to be adjustable by a user.

Aspects of the toy can include one or more of the following advantages. For example, the toy has a realistic appearance due to the motion of the arm and the flexible skin. Additionally, the motion of the arm is adjustable by a user.

Other features will be apparent from the description, the drawings, and the claims.

DESCRIPTION OF DRAWINGS

Like reference symbols in the various drawings indicate like elements.

DETAILED DESCRIPTION

Figure 1A:
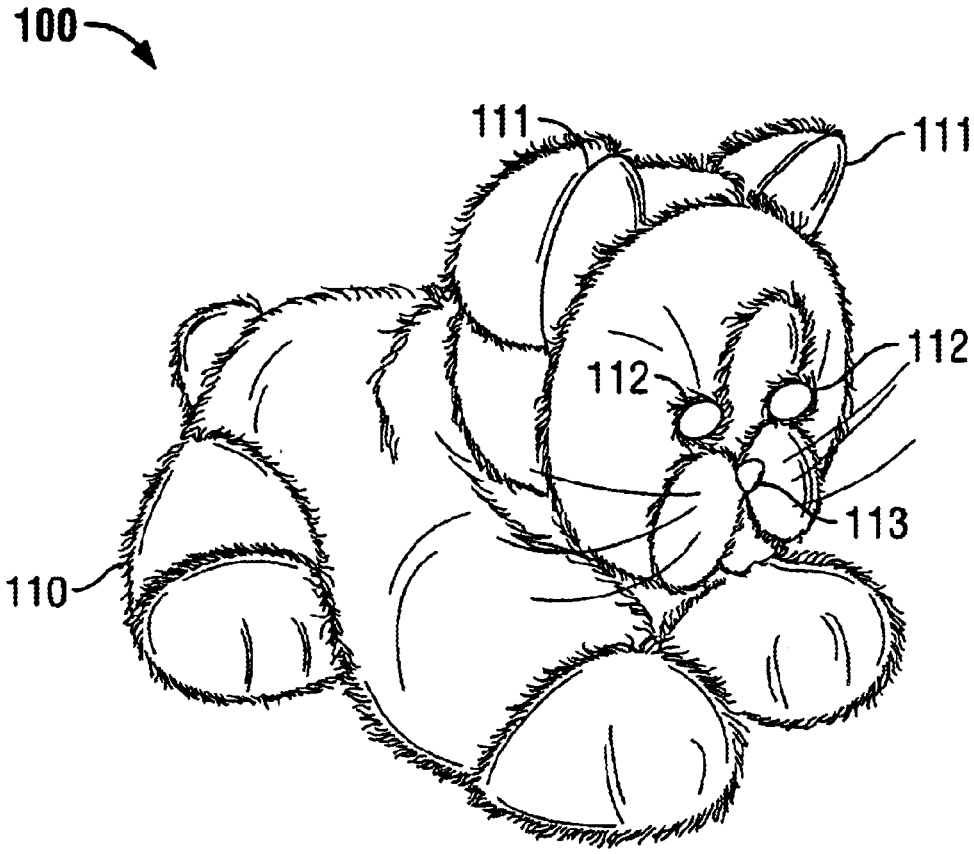
FIGS. 1A–1C are perspective views of a toy.
Figure 2:
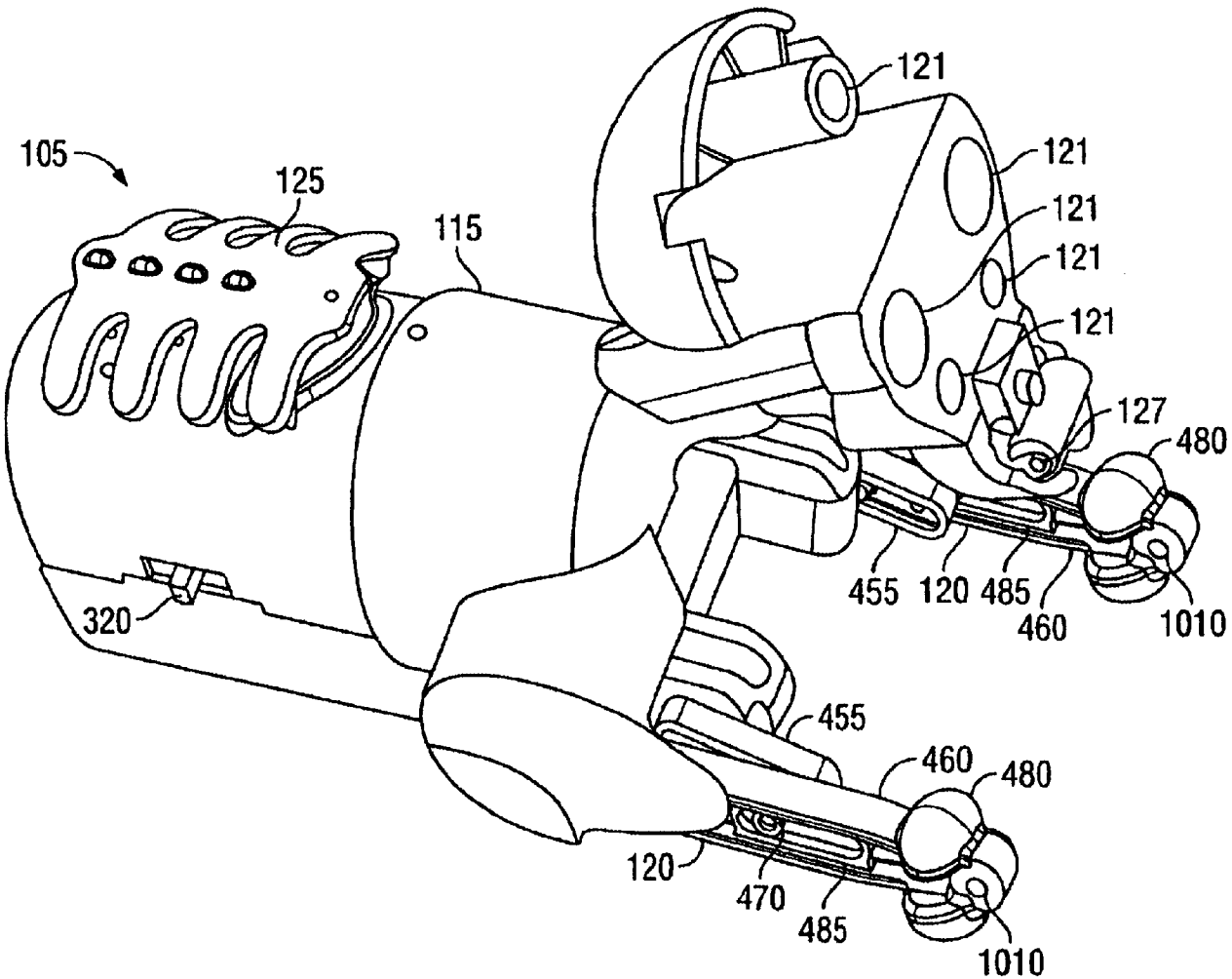
FIG. 2 is a perspective view of an internal shell of the toy of FIGS. 1A–1C.
Figure 3:
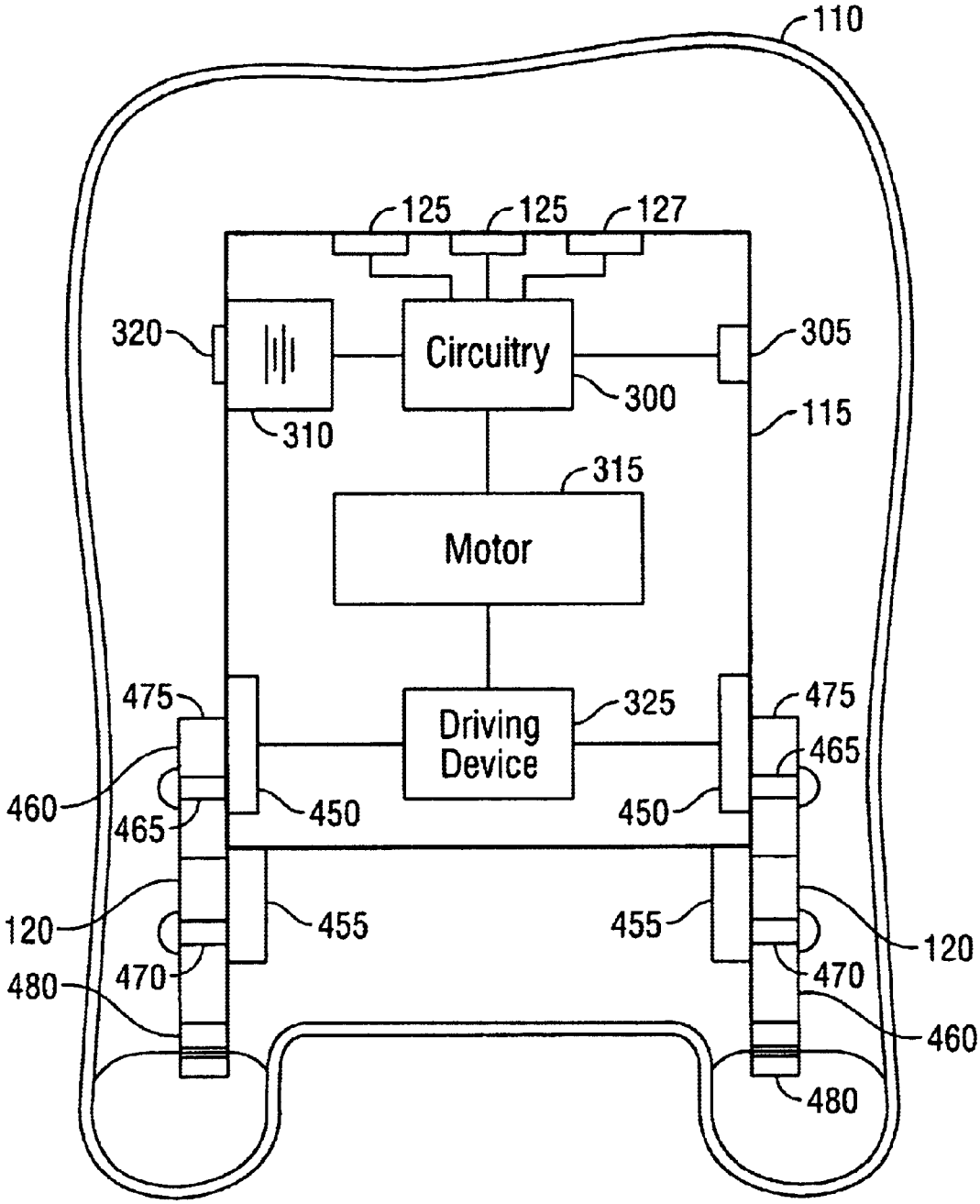
FIG. 3 is a block diagram of the toy of FIGS. 1A–1C.

Referring to FIGS. 1A, 2, and 3, a toy 100 is designed to provide realistic movement in response to a sensed condition. To this end, the toy 100 has an internal shell 105 surrounded by an external flexible skin 110. The internal shell 105 includes a body 115 and one or more appendages 120 connected to the body 115. The body 115 of the toy 100 houses components that control operation of the toy 100. The appendages 120 may be actuated during operation of the toy 100 in response to input received from one or more input devices in the form of sensors 125 and 127.

The external flexible skin 110 is shaped to fit over the internal shell 105 and includes rigid pieces, such as, for example, posts, that interfit with cavities 121 of the internal shell to facilitate securing of the skin 110 to the shell 105. Additionally, ears 111, eyes 112, and a nose 113 are formed into the skin 110 instead of the shell 105 to facilitate securing of the skin 110 to the shell 105.

The internal shell 105 may be made of any suitable combination of materials. For example, the body 105 and the appendages 120 may be made of plastic and/or metal. The external flexible skin 110 may be made of a resilient material that is covered with one or more external soft layers, such as pile that resembles an animal's coat. As shown, the toy 100 is in the shape of a kitten and the external flexible skin 110 resembles the coat of a kitten.

Figure 1B:
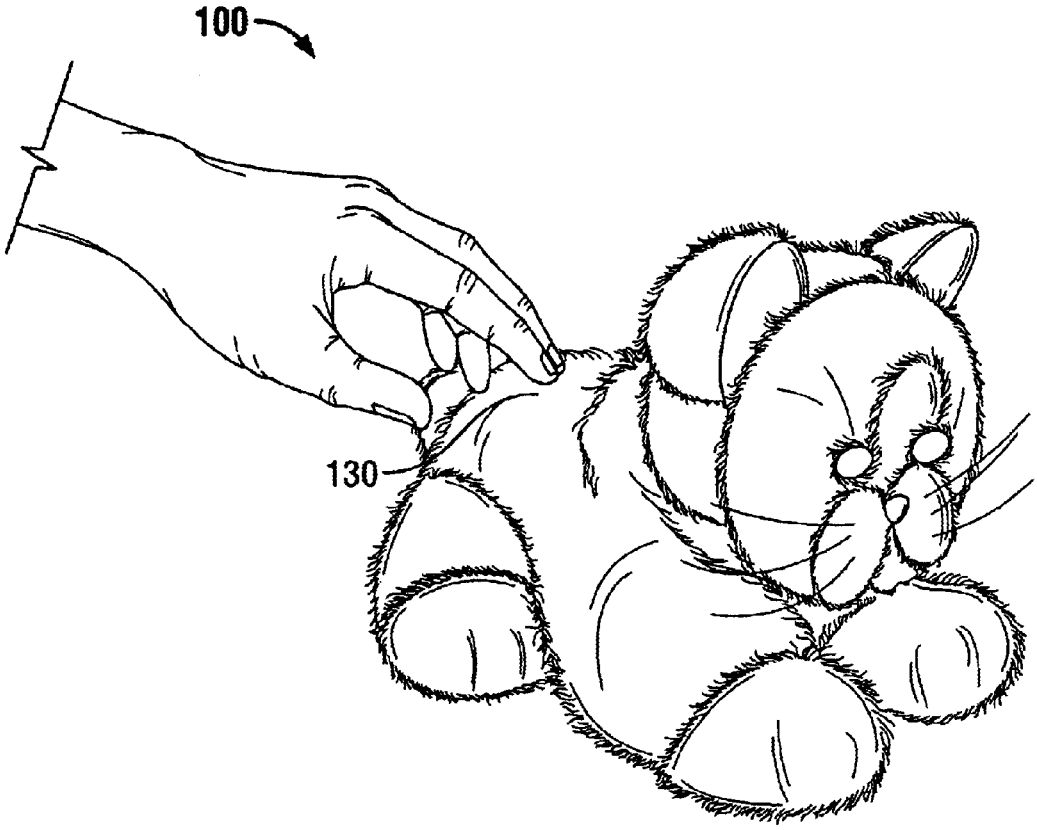
Figure 1C:
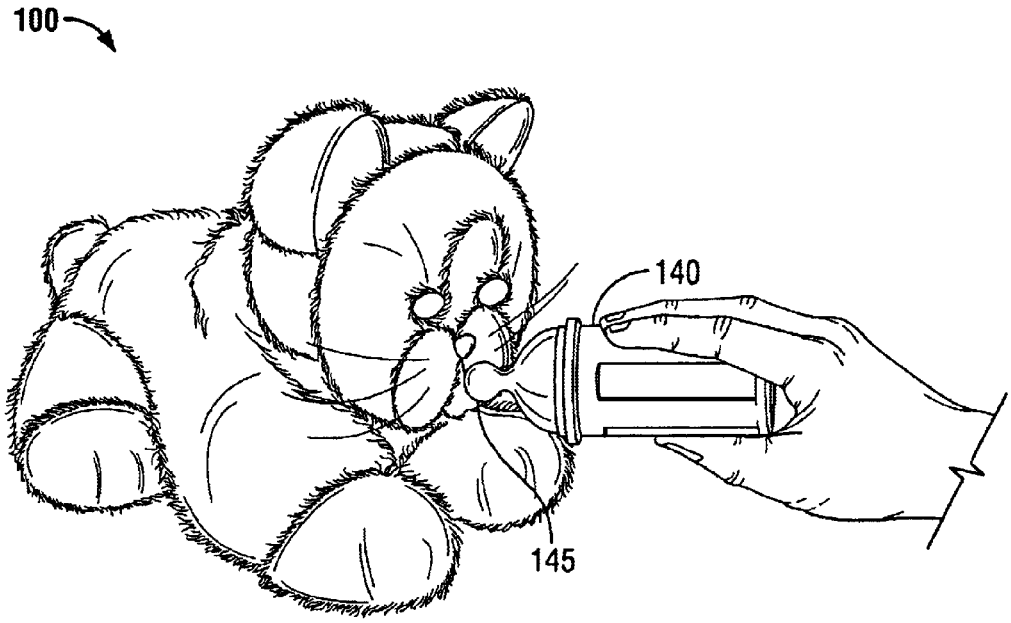

Referring also to FIG. 1B, the sensors 125 are pressure sensitive switches such that when a user touches the toy 100 at a location 130 near the sensor 125, the sensor 125 is depressed and an underlying button switch is pushed. Referring also to FIG. 1C, the sensor 127 is a magnetic switch, such as, for example, a reed switch or a Hall effect sensor, that is actuated by a magnet within an accessory 140 when the accessory 140 is placed at a location 145 near the sensor 127.

As shown in FIG. 3, internal circuitry 300 and an output device in the form of an audio device 305 are housed within the body 115. The sensors 125 and 127 and the audio device 305 are connected to the circuitry 300. The circuitry 300 receives power from an energy source 310 and controls operation of a motor 315 housed within the body 115. The energy source 310 may be provided by batteries that are placed within a compartment on a lower side of the body 115. The circuitry 300 is turned off and on by a switch 320 accessible on the body 115.

Figure 4:
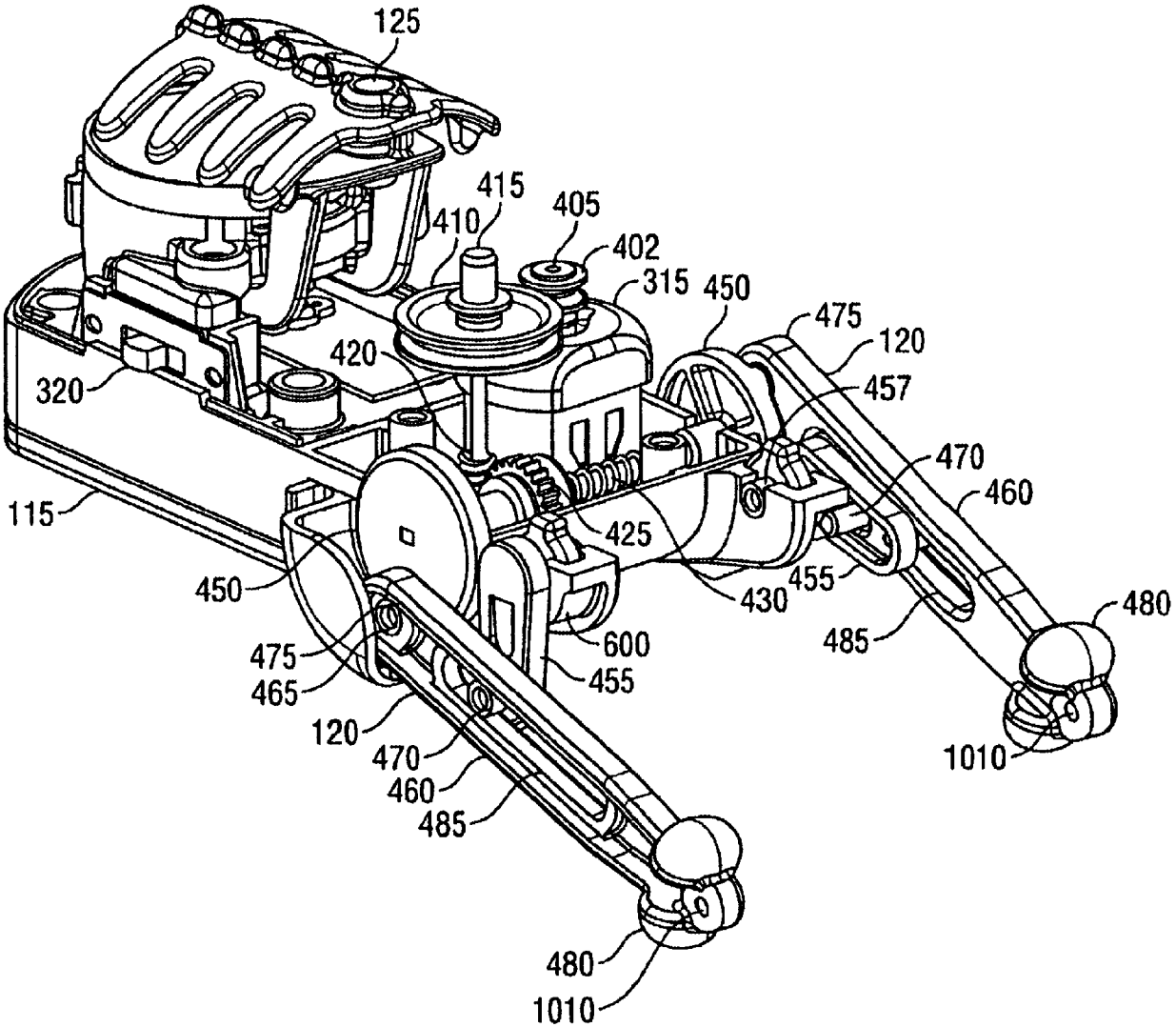
FIG. 4 is a perspective view of a portion of the internal shell of FIG. 2.
Figure 5:
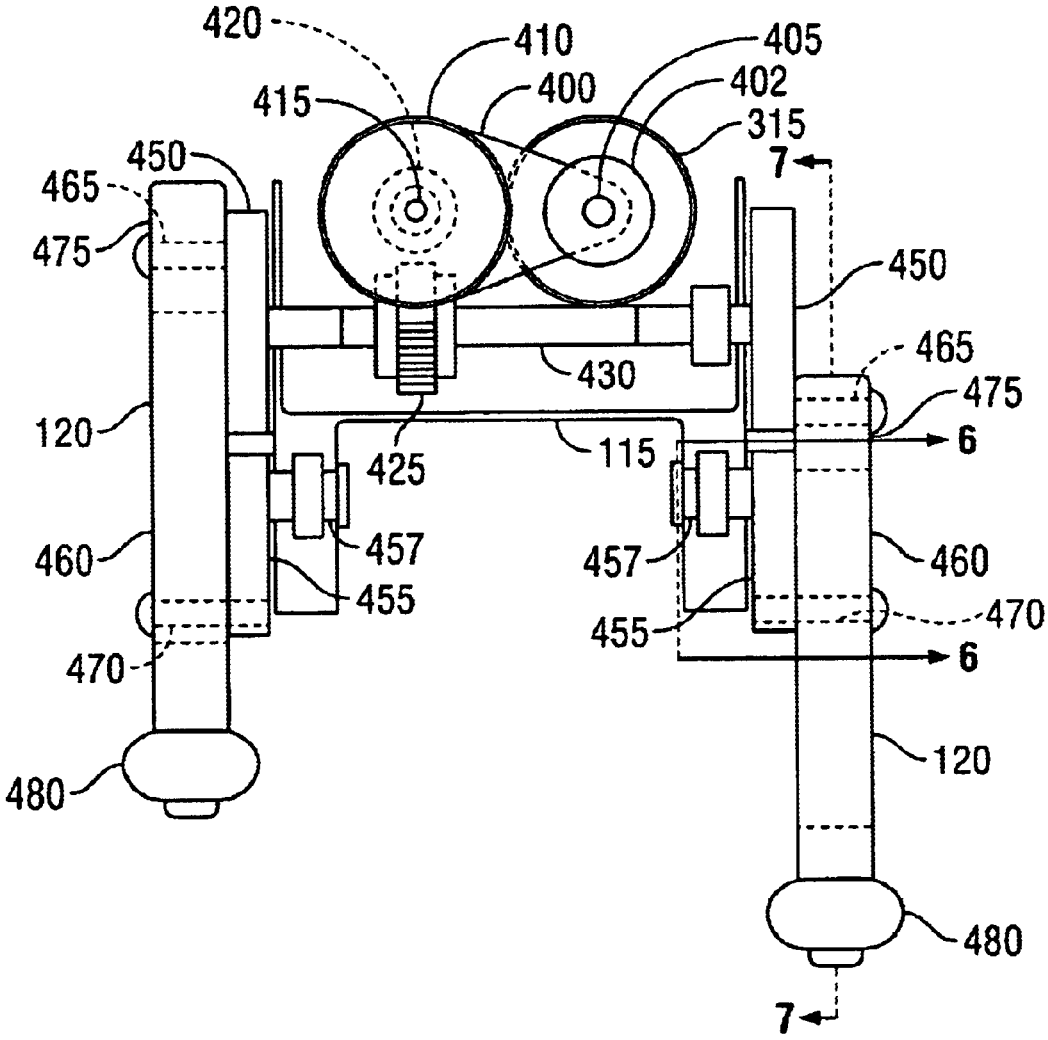
FIG. 5 is a plan view of a driving device and appendages of the toy of FIGS. 1A–1C.

A driving device 325 housed within the body 115 couples the motor 315 to the appendages 120. Referring also to FIGS. 4 and 5, the driving device 325 includes a flexible belt 400 connected to a pulley 402 mounted on a shaft 405 of the motor 315, and a pulley 410 that is driven by the belt 400. The pulley 410 is mounted on a shaft 415 and a worm gear 420 is connected to the shaft 415. The worm gear 420 couples with a gear 425 on a disk shaft 430 that spans the length of the body 115.

Each of the appendages 120 includes a disk 450 coupled with the disk shaft 430, a linkage 455 coupled with the body 115 at a linkage shaft 457, and an arm 460 coupled with the disk 450 and the linkage 455. As shown, the linkage shaft 457 of one of the appendages 120 is separated from the linkage shaft 457 of the other appendage 120. An eccentric rod 465 is positioned along and integral with an outer surface of the disk 450 and a linkage rod 470 is positioned along and integral with an outer surface of the linkage 455. A first end 475 of the arm 460 is rotatably fixed to the eccentric rod 465 and a second end 480 of the arm 460 is free to move. The arm 460 defines a slot 485 extending between the first end 475 and the second end 480. The slot 485 is wide enough to accommodate the linkage rod 470, which is engaged with the slot 485. In this way, the arm 460 is constrained by the engagement of the slot 485 with the linkage rod 470 and by the fixed connection of the first end 475 to the eccentric rod 465.

Figure 6A:
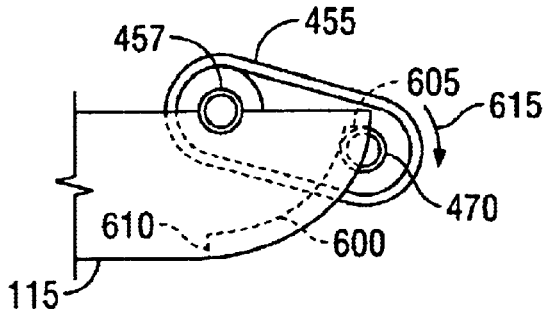
FIGS. 6A–6C are cross-sectional views of an appendage taken along line 6–6 of FIG. 5.
Figure 6B:
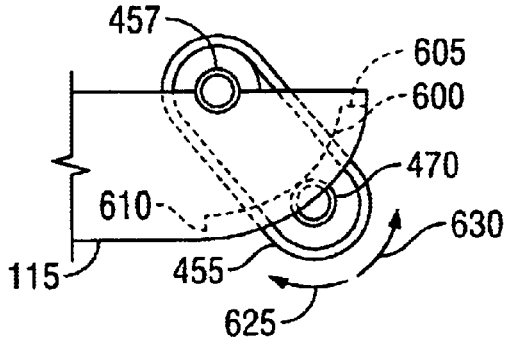
Figure 6C:
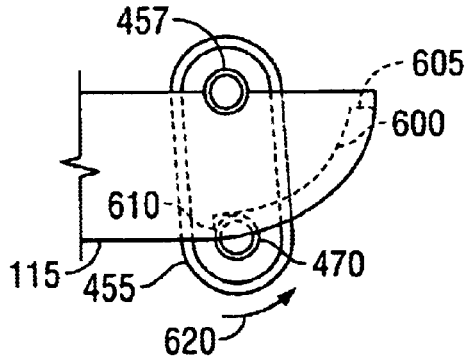
Figure 7A:
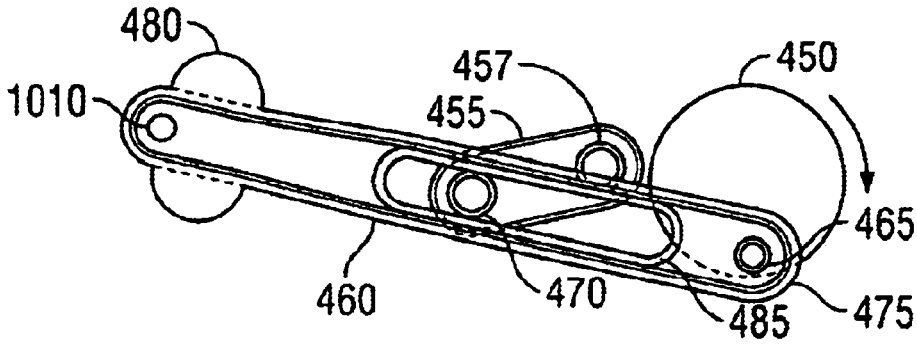
FIGS. 7A–9D are side views of an appendage of the toy of FIGS. 1A–1C.
Figure 7B:
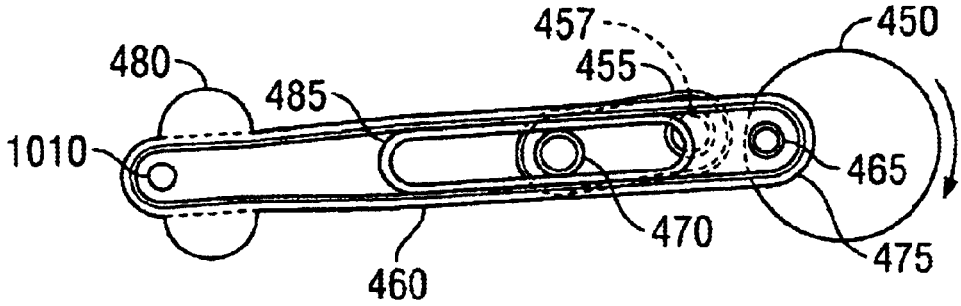
Figure 7C:
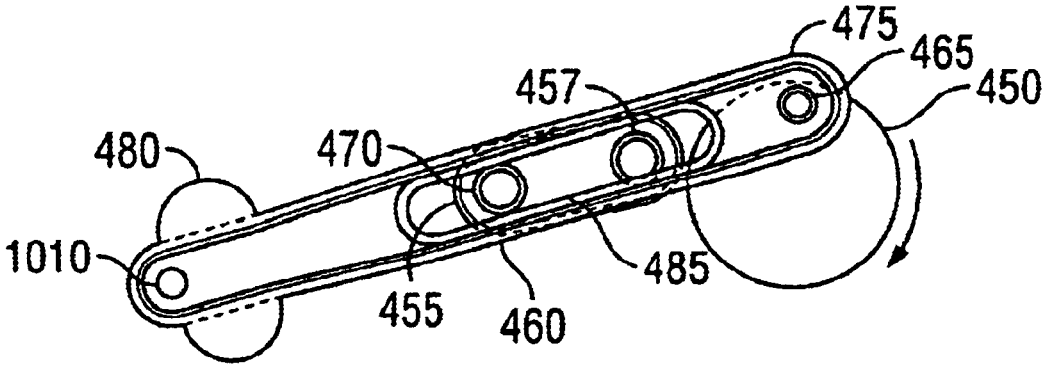
Figure 7D:
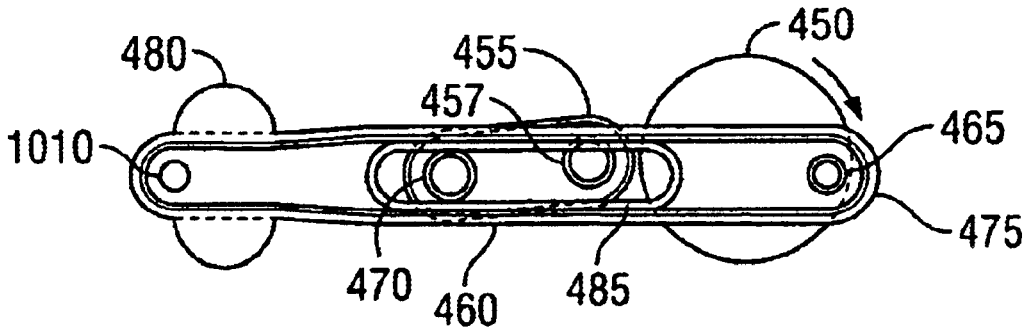
Figure 8A:
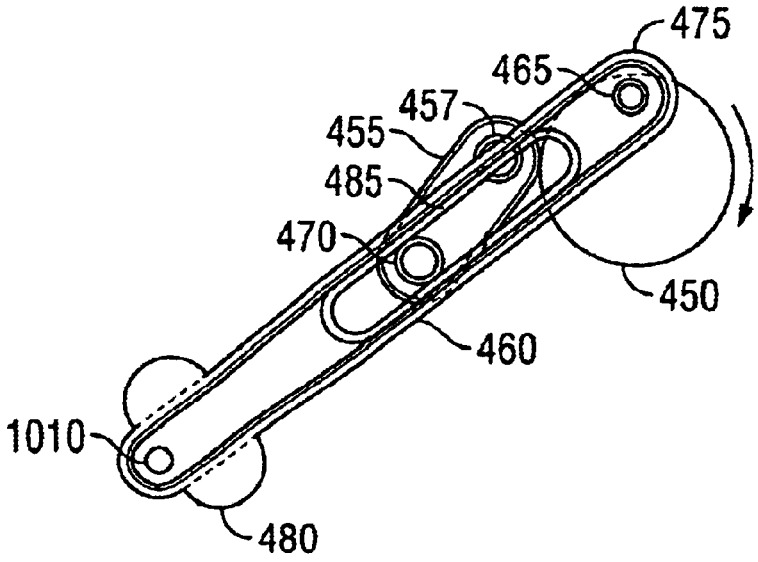
Figure 8B:
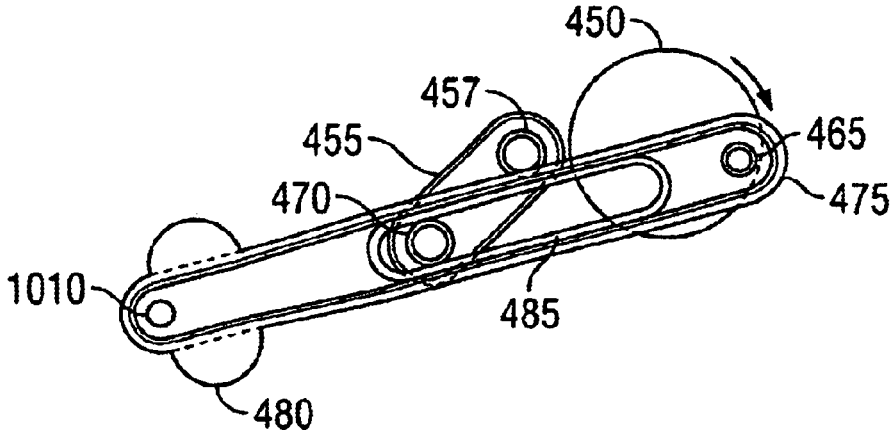
Figure 8C:
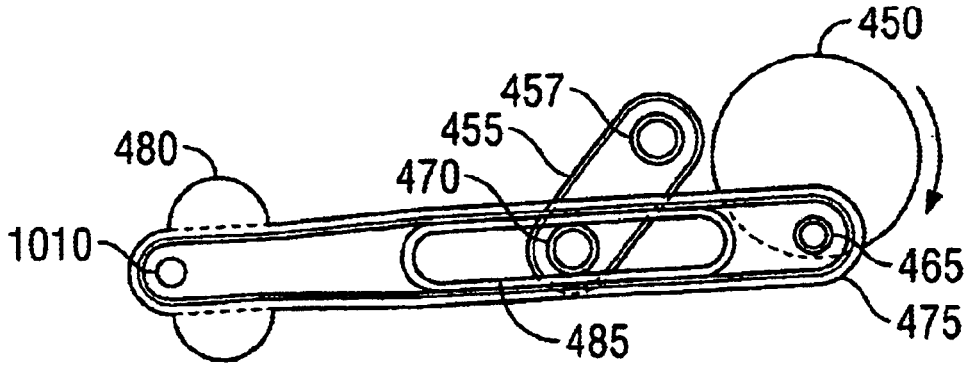
Figure 8D:
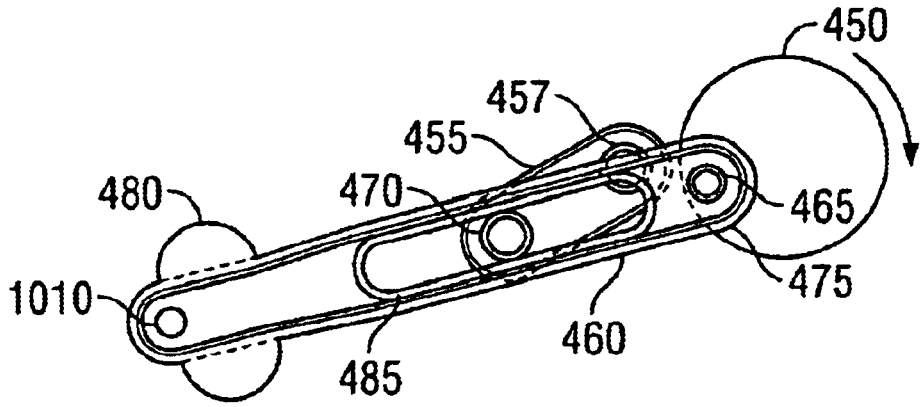
Figure 9A:
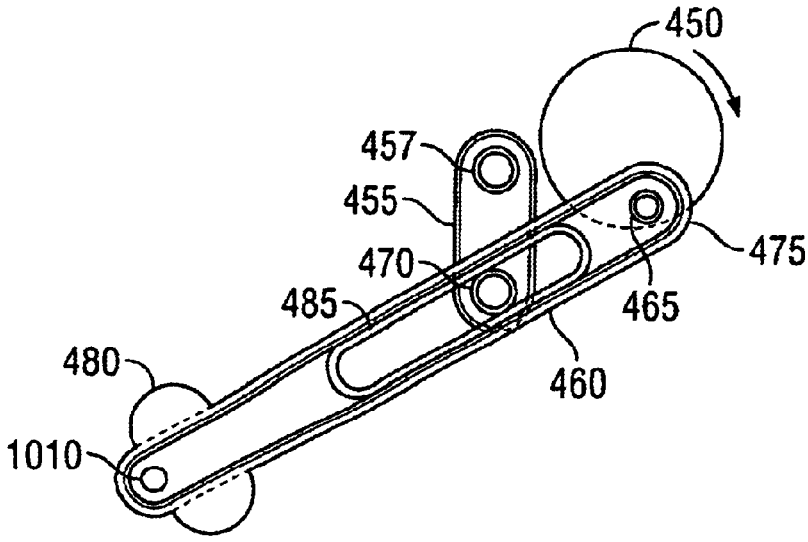
Figure 9B:
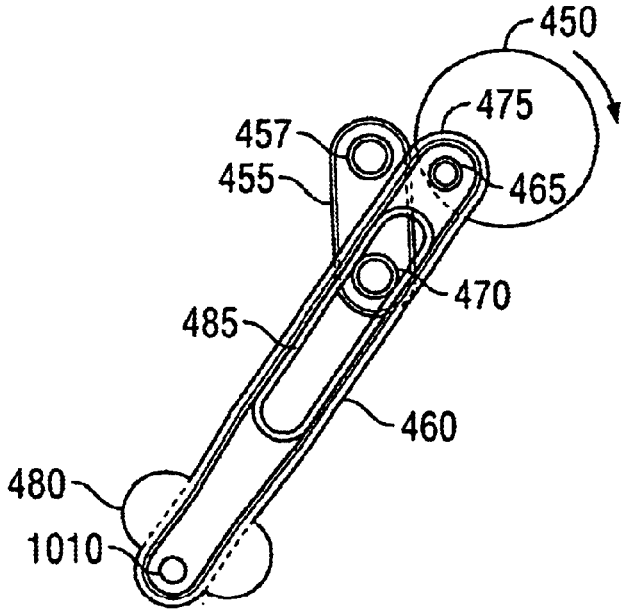
Figure 9C:
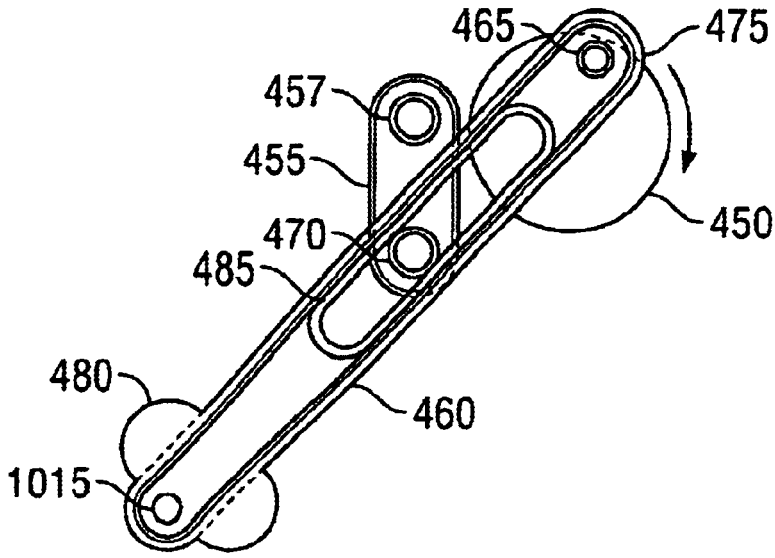
Figure 9D:
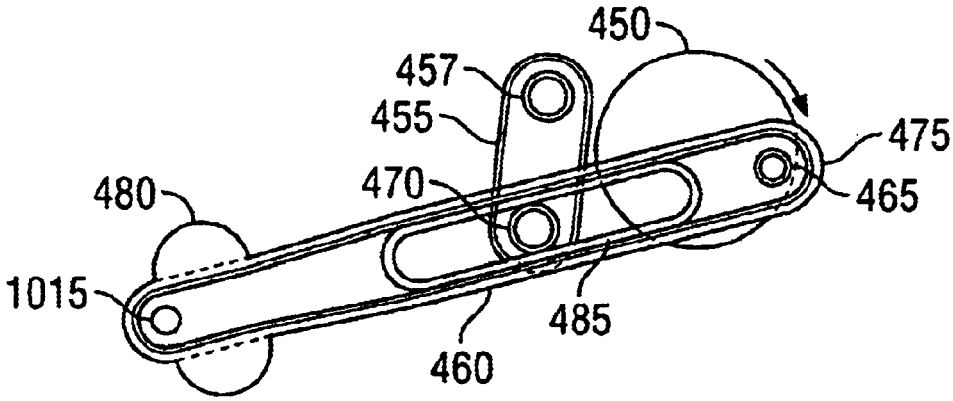

FIGS. 6A–6C show the linkage 455 positioned about the linkage shaft 457 to which it is coupled in an upper position (FIG. 6A), an intermediate position (FIG. 6B), and a lower position (FIG. 6C). The linkage rod 470 frictionally engages a rounded surface 600 of the body 115 such that the linkage rod is held in position relative to the body 115 absent application of an external force. The linkage 455 remains in its position and does not freely rotate because the rounded surface 600 exerts a static friction force on the linkage rod 470. The linkage 455 may be rotated about the linkage shaft 457 if enough force is applied by a user to overcome the static friction force exerted on the linkage rod 470.

In addition, the linkage 455 is prevented from rotating beyond the limited positions shown in FIGS. 6A and 6C due to contact of the linkage rod 470 with stops 605 and 610. In particular, as shown in FIG. 6A, the linkage 455 is prevented from rotating in a direction opposite arrow 615 because the linkage rod 470 is contacting the stop 605. Similarly, as shown in FIG. 6C, the linkage 455 is prevented from rotating in a direction opposite arrow 620 because the linkage rod 470 is contacting the stop 610. As shown in FIG. 6B, when sufficient force is applied the linkage 455 is free to move in either direction between the stops as depicted by arrows 625 and 630.

The user applies the external force to the linkage 455 to adjust the position of the linkage 455 by rotating the arm 460 while the motor 315 and the disk shaft 430 are static. When the user has finished adjusting the position of the linkage 455, the user turns on the toy 100 and circuitry 300 by actuating the switch 320. Upon receipt of a sensed condition (for example, from an input device 125 or 127), the circuitry 300 actuates the driving device 325, which rotates the disks 450. In particular, the circuitry 300 actuates the motor 315, which causes the motor shaft 405 to rotate. The rotation of the motor shaft 405 causes the pulley 402 to rotate and move the belt 400, which causes the pulley 410 and the shaft 415 to rotate. As the shaft 415 rotates, the worm gear 420 turns and causes the gear 425 and the disk shaft 430 to rotate. The rotation of the disk shaft 430 causes the disks 450 to rotate.

FIGS. 7A–7D illustrate movement of an arm 460 in response to rotation of a disk 450. In FIGS. 7A–7D, the linkage rod 470 is positioned to contact the stop 605 (as shown in FIG. 6A) such that the linkage rod 470 may not move up relative to the linkage shaft 457. Note that the orientation of the linkage 455 in FIGS. 7A–7D is inverted relative to the orientation in FIGS. 6A–6C such that the linkage 455 in FIGS. 7A–7D rotates in a counter-clockwise direction when moving down and a clockwise direction when moving up. Rotation of the disk 450 causes the first end 475 of the arm 460, which is rotatably fixed to the eccentric rod 465, to rotate in a circular path, Rotation of the first end 475 of the arm 460 causes the arm 460 to pivot about and move transversely to the linkage rod 470, which causes the second end 480 to move in a non-circular or irregular path (as shown by the sequence of FIGS. 7A–7D).

The non-circular path that the second end 480 traverses is dependent on the position of the linkage 455 about the linkage shaft 457, that is, the angle of the linkage 455 relative to the stop 605 or 610. Thus, for example, as shown in the sequence depicted in FIGS. 8A–8D, when the linkage rod 470 is positioned between the limited positions and the linkage 455 is able to move either up or down (as shown in FIG. 6B), the second end 480 traverses a path that is different from the path depicted in FIGS. 7A–7D (in which the linkage rod 470 is contacting the stop 605 as shown in FIG. 6A). As shown in FIGS. 9A–9D, when the linkage rod 470 is positioned to contact the stop 610 (as shown in FIG. 6C), the second end 480 traverses a path that is different from either of the paths depicted in FIGS. 7A–7D and 8A–8D. As the linkage rod 470 moves from the stop 605 to the stop 610, the non-circular path traversed by the second end 480 may become more and more exaggerated and/or more irregularly shaped.

Moreover, the two linkages 455 of the toy 100 are independently positionable such that the arms 460 can be configured to simultaneously traverse different non-circular paths (such a configuration is shown in FIG. 4). To further enhance the realism of the toy 100, the eccentric rods 465 of the two arms 460 may be out of alignment by 180° (such a configuration is shown in FIGS. 2, 4, and 5). In this configuration, the second ends 480 of the arms 460 are out of alignment for most of the cycle of the disks 450.

Figure 10:
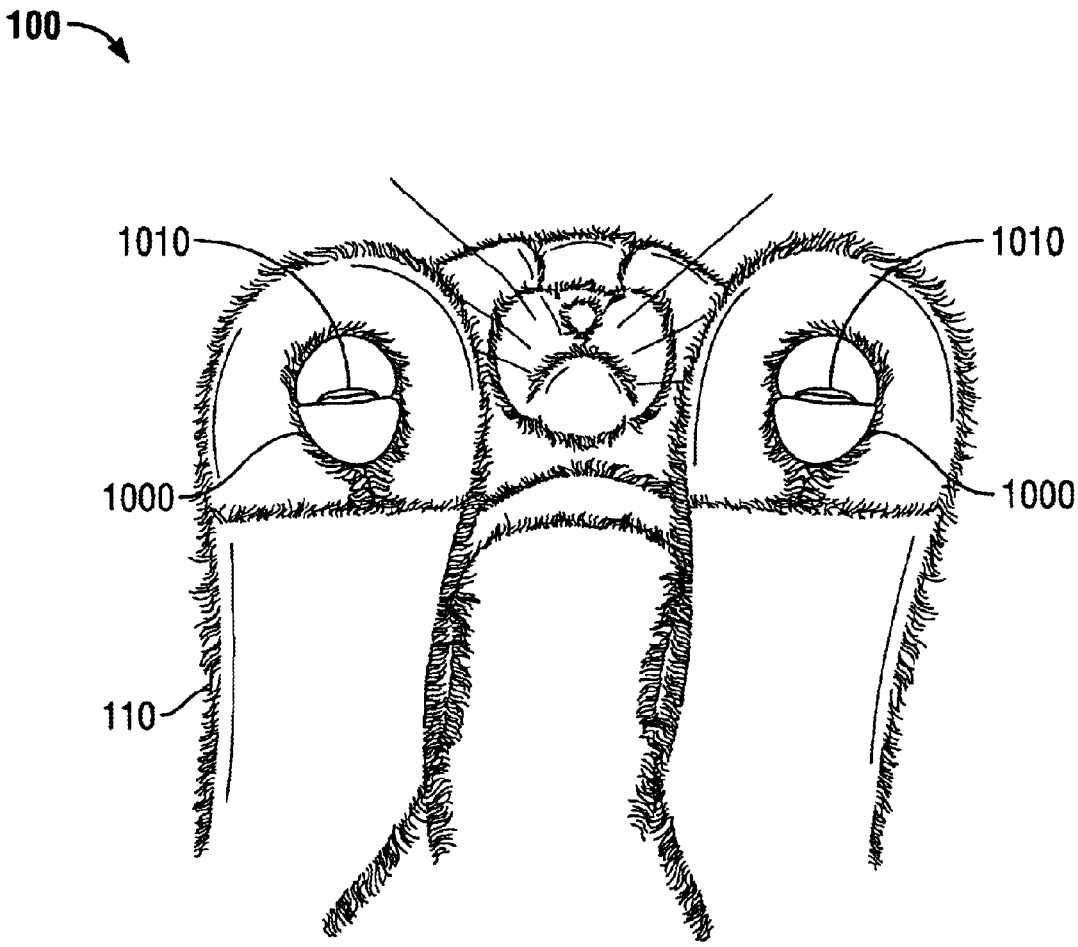
FIG. 10 is a perspective view of an underside of the toy of FIGS. 1A–1C.
Figure 11A:
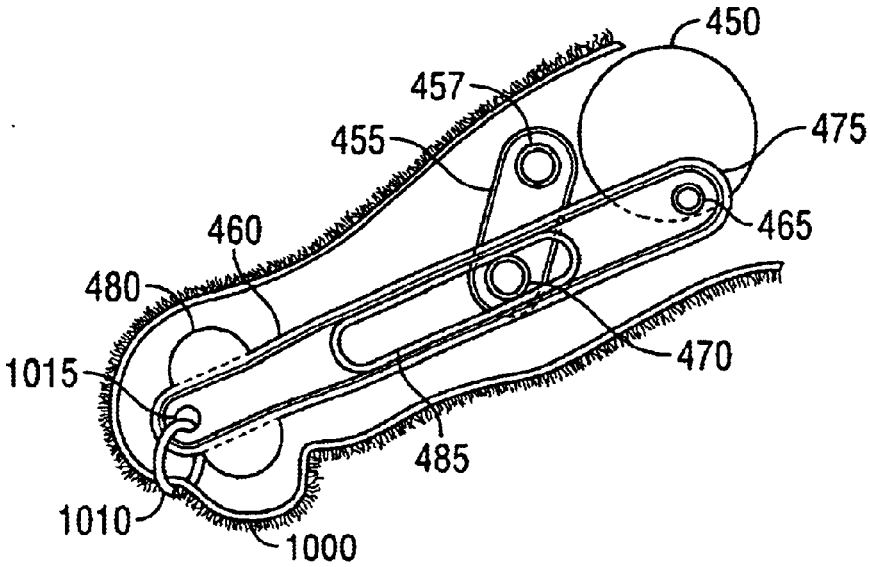
FIGS. 11A and 11B are side and partial cutaway views of an appendage and external flexible skin of the toy of FIGS. 1A–1C.
Figure 11B:
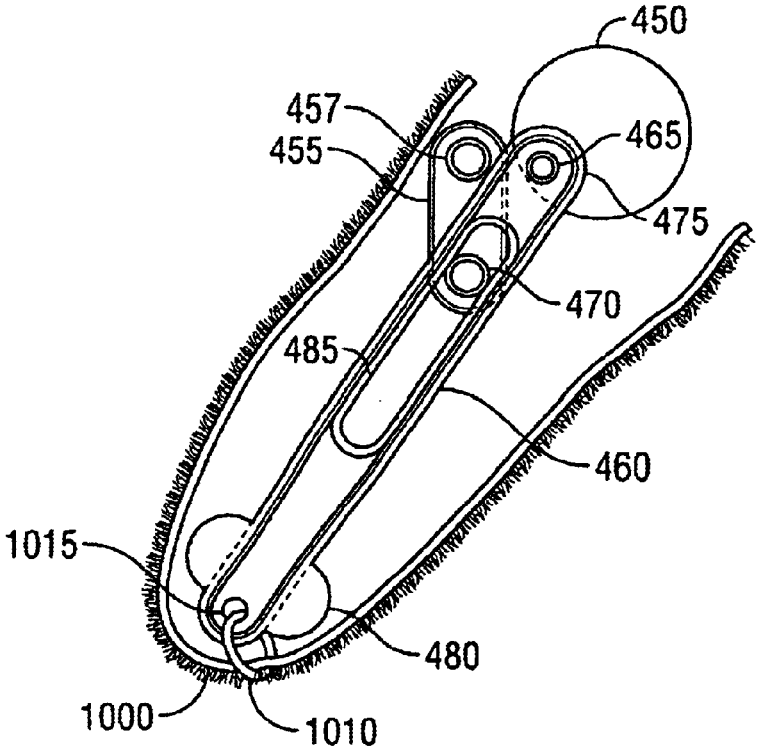

Referring also to FIGS. 10, 11A, and 11B, a portion 1000 of the external flexible skin 110 is fastened to the second end 480 of an arm 460. For example, the portion 1000 may be sewed with thread 1010 to an eye 1015 formed in the second end 480. As the second end 480 traverses the non-circular path, the portion 1000 of the skin 110 is periodically pulled toward (tensioning) and away from (slackening) the second end 480. This periodic tensioning and slackening causes the skin 110 in the portion 1000 to deform during the disk cycle. The overall motion of the arms 460 and the skin 110 of the toy 100 imparts a realistic appearance of a kitten performing a kneading action. Moreover, to further enhance realism, as the arms 460 are moved, the circuitry 300 sends a signal to the audio device 305 to output a sound such as a "meow" or a "purr".

Other implementations are within the scope of the following claims. For example, the toy 100 may be of any design, such as, for example, a doll, a plush toy such as a stuffed animal, a dog or other animal, or a robot.

One or more of the sensors 125 or 127 may be touch-sensitive devices. For example, one or more of the sensors 125 or 127 may be a pressure sensing device such as, for example, a pressure-activated switch in the form of a membrane switch. As another example, a sensor 125 or 127 may be made of a conductive material and be an inductively-coupled device. In this case, when a user touches the toy 100 at the location of the inductive sensor, a measured inductance associated with the inductive sensor changes and the change is sensed. As a further example, a sensor 125 or 127 may be made of a conductive material and be a capacitively-coupled device such that when a user touches the toy 100 at the location of the capacitive sensor, a measured capacitance associated with the sensor changes and the change is sensed. One or more of the sensors 125 or 127 may be a light-sensing device, such as, for example, an IR-sensing device or a photocell. Additionally or alternatively, one or more of the sensors 125 or 127 may be a sound-sensing device such as, for example, a microphone.

The output device may be an optical device, such as, for example, a lamp or a light emitting diode, or an electromechanical device. The flexible skin 110 may include a resilient material to further enhance realism of the toy 100.

The two linkages 455 of the toy 100 may be positionable such that the arms 460 can be configured to simultaneously traverse identical non-circular paths. The eccentric rods 465 of the two arms 460 may be out of alignment by any angle (from 0° to 180°) or the rods 465 may be aligned. The linkage shafts 457 of the appendages 120 may form an integral shaft between the appendages 120.

The user may adjust the linkage 455 directly by grasping the linkage 455 through the skin 110 while the skin 110 is surrounding the shell 105 or by grasping the linkage 455 after the skin 110 has been removed from the shell 105.

What is claimed is:

1. A toy comprising:

a body; and an appendage system at a side of the body and including:

an arm including a first end fixed to rotate in a circular path and a second unfixed end, the arm defining a slot extending between the first and second ends; and a linkage including a linkage rod that is engaged with the slot, the linkage being positionable about a linkage shaft coupled to the body;

wherein rotation of the first end of the arm causes the second unfixed end of the arm to move in a non-circular path that varies depending on the position of the linkage about the linkage shaft.

2. The toy of claim 1 further comprising a disk including an eccentric rod, the disk being rotatable about a disk shaft coupled to the body, wherein the first end of the arm is fixed to the eccentric rod to rotate in the circular path of the eccentric rod.

3. The toy of claim 2 further comprising an actuator within the body and coupled to rotate the disk.

4. The toy of claim 3 in which the actuator comprises:

an energy source;

a motor connected to the energy source; and a driving device connected to the motor and coupled with the first end of the arm to rotate the first end of the arm when the motor operates.

5. The toy of claim 1 further comprising a sensor connected to cause the first end of the arm to rotate in response to a sensed condition.

6. The toy of claim 1 further comprising another appendage system shaped like the appendage system and positioned at another side of the body, wherein rotation of a first end of an arm of the other appendage system causes a second end of the arm of the other appendage system to move in a non-circular path that varies depending on the position of a linkage of the other appendage system relative to another linkage shaft coupled to the body.

7. The toy of claim 6 wherein the eccentric rods of each of the appendage systems are positioned such that second end of the appendage system moves in a non-circular path that is offset from the non-circular path in which the second end of the other appendage system moves.

8. The toy of claim 1 further comprising another appendage system shaped like the appendage system and positioned at another side of the body, wherein rotation of a first end of an arm of the other appendage system causes a second end of the arm of the other appendage system to move in a non-circular path that varies depending on the position of a linkage of the other appendage system relative to the linkage shaft coupled to the body.

9. The toy of claim 1 further comprising a flexible skin surrounding the appendage system.

10. The toy of claim 9 wherein the flexible skin includes pile that resembles an animal's coat.

11. The toy of claim 9 wherein the flexible skin moves as the arm moves.

12. An appendage system of a toy, the system including:

an arm including a first end configured to rotate in a circular path and a second unfixed end, the arm defining a slot extending between the first and second ends; and a linkage including a linkage rod that is engaged with the slot, the linkage being positionable about a linkage shaft coupled to the body;

wherein rotation of the first end of the arm causes the second unfixed end of the arm to move in a non-circular path that varies depending on the position of the linkage about the linkage shaft.

13. The system of claim 12 further comprising a disk including an eccentric rod, the disk being rotatable about a disk shaft coupled to the body, wherein the first end of the arm is fixed to the eccentric rod to rotate in the circular path of the eccentric rod.

14. The system of claim 12 wherein the first end of the arm rotates in response to a sensed condition from a sensor within the toy.

15. A toy comprising:

an arm including a first end configured to rotate in a circular path and a second unfixed end, the arm defining a slot extending between the first and second ends and defining an eye at the second end;

a linkage including a linkage rod that is engaged with the slot;

a flexible skin that covers the arm, the flexible skin including a portion that is sewed to the eye;

wherein rotation of the first end of the arm causes the second unfixed end of the arm to move along a non-circular path and causes the sewed portion of the flexible skin to periodically tension and slacken as the arm moves along the non-circular path.

16. The toy of claim 15 further comprising a disk including an eccentric rod, the disk being rotatable about a disk shaft coupled to the body, wherein the first end of the arm is fixed to the eccentric rod to rotate in the circular path of the eccentric rod.

17. The toy of claim 16 further comprising an actuator within the body and coupled to rotate the disk.

18. The toy of claim 17 in which the actuator comprises:

an energy source;

a motor connected to the energy source; and a driving device connected to the motor and coupled with the first end of the arm to rotate the first end of the arm when the motor operates.

19. A toy comprising:

a body; and an arm at a side of the body, the arm being coupled to only one drive shaft within the body, the arm including:

a first end that is fixed to rotate along a circular path as the drive shaft rotates, and a second unfixed end that moves in a non-circular path as the first end rotates;

wherein a shape of the movement of the second unfixed end along the non-circular path is based on an initial orientation of a linkage coupled to the arm.

20. A toy comprising:

a body; and an arm at a side of the body, the arm having a first end that is fixed to rotate along a circular path and a second unfixed end that moves in a non-circular path as the first end rotates;

wherein a shape of the movement of the second unfixed end along the non-circular path is based on an initial orientation of a linkage coupled to the arm; and wherein the initial orientation of the linkage is configured to be adjustable by a user.

* * * * *